United States Patent [19]

Venturini

[11] Patent Number: 4,850,077

[45] Date of Patent: Jul. 25, 1989

[54] DOUBLE BRUSH-ROLL VACUUM CLEANER

[76] Inventor: Domenico Venturini, 848 Los Palos Dr., Salinas, Calif. 93901

[21] Appl. No.: 245,307

[22] Filed: Sep. 15, 1988

[51] Int. Cl.[4] ..... A47L 5/30

[52] U.S. Cl. ..... 15/384; 15/389

[58] Field of Search ..... 15/384, 389

[56] References Cited

U.S. PATENT DOCUMENTS

| | | | |
|---|---|---|---|
| 664,135 | 12/1900 | Dufour | 15/384 X |
| 1,268,963 | 6/1918 | Gray | 15/384 X |
| 1,891,504 | 12/1932 | Smellie | 15/384 |
| 1,939,579 | 12/1933 | Swartz | 15/384 X |
| 4,426,751 | 1/1984 | Nordeen | 15/384 |
| 4,654,927 | 4/1987 | Novinger | 15/384 X |

FOREIGN PATENT DOCUMENTS

| | | | |
|---|---|---|---|
| 1916484 | 10/1970 | German Democratic Rep. | 15/384 |

*Primary Examiner*—Chris K. Moore

[57] ABSTRACT

The invention consists of an upright vacuum cleaner having two oppositely rotating brush rolls, eliminating substantially all the resistance to movement of the cleaner along a carpet caused by a single brush roll. A single belt drives both rolls. The rear brush roll has two circumferential grooves, to accommodate the incoming and outgoing runs of the belt to reduce friction and wear. The belt is twisted 180° between the rolls, and runs in a single groove in the front brush.

2 Claims, 1 Drawing Sheet

DOUBLE BRUSH-ROLL VACUUM CLEANER

BACKGROUND OF THE INVENTION

This invention relates to vacuum cleaners, and in particular to an upright vacuum cleaner with a rotating cylindrical brush roll for agitating the surface and pile of a carpet.

Existing upright vacuum cleaners require more energy to propel in one direction than the other, due to the resistance to motion caused by the rotating brush roll in one direction of movement.

OBJECTS AND SUMMARY OF THE INVENTION

The present invention comprehends an improved brush system for upright vacuum cleaners requiring less physical effort to operate than a comparable single roll cleaner.

It is an object of the present invention to provide a vacuum cleaner requiring a reduced amount of energy to operate.

It is a further object to provide a vacuum cleaner with two counter-rotating brush rolls.

It is another object to provide two rotating brush rolls driven by a single drive belt.

BRIEF DESCRIPTION OF THE DRAWINGS

Other features of the invention will be apparent from the following description in combination with the accompanying drawing, wherein.

DESCRIPTION OF THE PREFERRED EMBODIMENT

Figure 1:
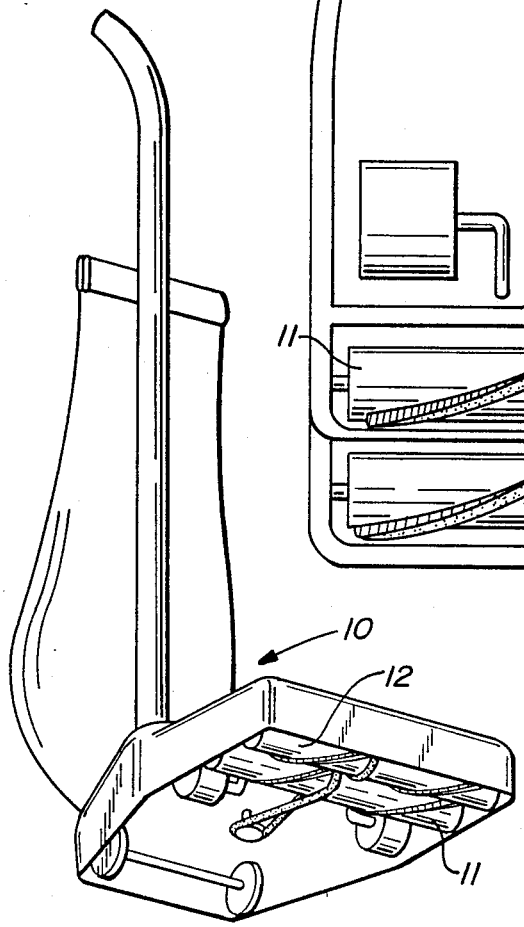
FIG. 1 is a perspective view from below and in front of a typical upright vacuum cleaner incorporating the invention residing in two brush rolls driven by a single belt.
Figure 2:
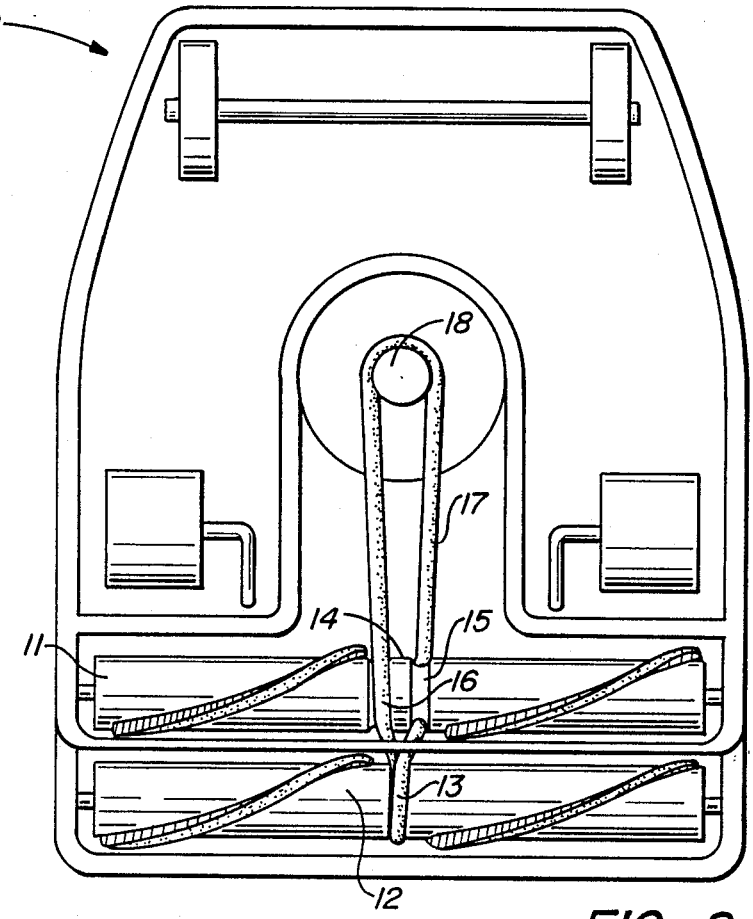
FIG. 2 is a plan view from beneath the apparatus of FIG. 1.
Figure 3:
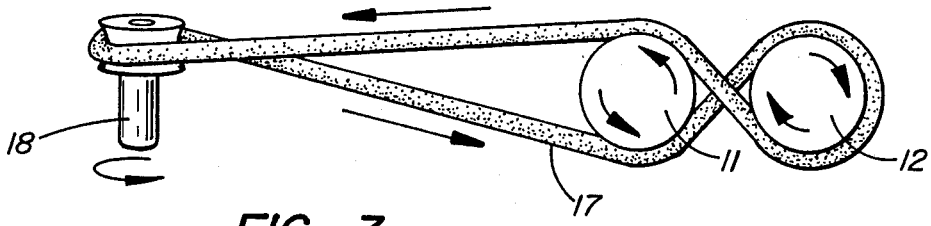
FIG. 3 is a schematic of the disposition of the drive shaft, belt and driven brush rolls.

In the illustrated embodiment of the invention as disclosed in FIGS. 1–3 of the drawing, a vacuum cleaner of the upright type is shown at 10 in FIG. 1, having two tandem-mounted brush rolls 11 and 12.

In FIG. 2, it can be seen that the rear brush roll 11 has two spaced circumferential grooves 15 and 16 separated by a ridge 14, to accommodate the outgoing and incoming (seen from the drive shaft 18) runs of the elongated, flexible endless loop drive belt 17.

When the two runs of the belt have passed over the rear brush roll, they form an X as seen from the ends of the rolls by being turned 180° and lopoed over the front brush roll 12, and rest in the single groove 13. The use of the additional groove in the rear brush roll separates the runs of the belt, eliminating frictional contact and the wear that would result from such contact, while allowing both runs of the belt to engage in driving in one direction, (counter-clockwise as seen in FIG. 3) while the front brush 12 is driven in the opposite, or clockwise direction.

Thus, the additional brush allows the vacuum cleaner to provide twice the agitation of the carpet pile, while eliminating the retarding force that a single brush roll exerts when pulled against its direction of rotational contact with the carpet.

The present invention may also be realized in existing, single-roll vacuum cleaners by means of elongation of the nozzle mouth to provide for the added brush 12; lengthening of belt 17; and a larger housing for accommodating the additional brush.

I claim:

1. An upright vacuum cleaner, comprising:

a wheel-supported housing with upwardly extending handle, said housing containing a motor-driven drive shaft;

two cylindrical brush rolls mounted in tandem for rotation in a nozzle portion of said housing;

the forward brush roll having a single circumferential groove, the rear brush roll having two separate but closely-spaced circumferential grooves; and an elongated flexible endless loop drive belt, said belt extending from said drive shaft through one of said two grooves on said rear brush roll, around the groove in the front brush roll, through the other of said grooves in said rear brush roll, and back to said shaft in such a manner that said brush rolls are driven in opposite directions.

2. A vacuum cleaner as in claim 1, wherein:

said belt runs to and from the front brush roll form an X when viewed from either end of said brush rolls.

* * * * *